US006589394B2

(12) United States Patent
Beck

(10) Patent No.: US 6,589,394 B2
(45) Date of Patent: Jul. 8, 2003

(54) CONTROLLED-FORCE END SEAL ARRANGEMENT FOR AN AIR PRESS OF A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/965,611

(22) Filed: Sep. 27, 2001

(65) Prior Publication Data

US 2003/0056923 A1 Mar. 27, 2003

(51) Int. Cl.[7] ..... D21F 3/02; F16J 15/16

(52) U.S. Cl. ..... 162/360.3; 100/155 R; 277/300; 277/345

(58) Field of Search ..... 162/205, 206, 162/358.1–358.5, 359.1, 360.2, 360.3, 361; 100/47, 118, 155 R, 161, 162 R, 168–170, 176; 34/115, 119, 122, 124, 601, 242; 384/275; 277/300, 358, 361, 363, 366–369, 377, 386, 387, 469, 558, 581, 583

(56) References Cited

U.S. PATENT DOCUMENTS 3,293,121 A * 12/1966 Martin ..... 100/163 R
3,315,370 A * 4/1967 Hikosaka ..... 100/118
3,804,707 A * 4/1974 Mohr et al. ..... 100/211
3,808,096 A * 4/1974 Busker et al. ..... 100/118
4,124,942 A * 11/1978 Ohls et al. ..... 34/115
4,173,249 A * 11/1979 Holkko et al. ..... 100/118
4,675,079 A * 6/1987 Webster ..... 100/118
5,164,047 A * 11/1992 Koski ..... 162/206

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

An air press for pressing a fiber web includes a plurality of rolls and a pair of end seal arrangements. Of the plurality of rolls, each pair of adjacent rolls forms a nip therebetween. Further, each roll has a pair of roll ends, the plurality of rolls together forming two sets of roll ends. Each end seal arrangement coacts with one set of roll ends, the plurality of rolls and the pair of end seal arrangements together defining an air press chamber having an air chamber pressure. Each end seal arrangement is composed of at least one roll seal, including a first roll seal, and an adjustable bias mechanism. Each roll seal forms a seal with at least one roll end, and one side of the first roll seal being exposed to the air chamber pressure. The adjustable bias mechanism is configured for controlling a position of each roll seal relative to a respective at least one roll end and for adjusting a seal force between the roll seal and the respective at least one roll end.

19 Claims, 2 Drawing Sheets

CONTROLLED-FORCE END SEAL ARRANGEMENT FOR AN AIR PRESS OF A PAPERMAKING MACHINE

STATEMENT REGARDING FEDERALLY SPONSORED RESEARCH OR DEVELOPMENT

This invention was made with Government support under Prime Contract No. DE-FC36-01GO10622 awarded by the Department of Energy. The Government has certain rights in this invention.

BACKGROUND OF THE INVENTION

1. Field of the Invention

The present invention relates to air presses for a papermaking machine, and, more particularly, to end seal arrangements therefor.

2. Description of the Related Art

Effective water removal from a paper web is essential to the papermaking process. Various types of presses, using some combination of juxtaposed rolls, have been used for some time now for water removal. Such presses rely on the hydraulic pressure created at the nip between each pair of juxtaposed rolls through which the paper web travels in a given press configuration to drive water from the paper web.

Various press have been developed which have attempted to add an element of a positive air pressure within the press assembly to more effectively force the water from the paper web. With respect to roll presses specifically, the rolls of the press have been configured to form a chamber with a positive air pressure being supplied therewithin.

However, the effectiveness of a multi-roll air presses is limited by the degree to which the air chamber thereof can be sealed. The areas of the press where sealing becomes quite crucial are those areas where the paper web and the membrane(s) carrying it do not pass, as the web/membrane (s) combination inherently acts to seal the region of each nip through which it passes. Those regions of the air press through which the paper web/membrane(s) combination does not pass are the opposed lateral ends of each nip and the opposed chamber ends defined by the two sets of roll end associated with the air press. Consequently, an end seal mechanism is provided at each chamber end, each such mechanism having a seal member which contacts each of the roll ends associated with that particular chamber end.

The ability of the end seal mechanism to efficiently seal a chamber is predicated on the application of a sufficient sealing force so that the seal member thereof maintains sealing contact with each of the roll ends of that chamber end. On the other hand, applying a force thereto that is greater than that needed to maintain a seal will cause the seal member to wear out quicker than is necessary.

Additionally, current end seal mechanisms do not facilitate adjustments in the positioning thereof or in the force ultimately applied on the seal member thereof With such systems, retraction of the end seal mechanisms for start-up and/or maintenance is not readily achieved. Additionally, it is difficult to optimize the forces applied to the seal member during start-up to initially achieve a sufficient seal therewith and yet promote a long life thereof.

What is needed in the art is an end seal mechanism in which the sealing force applied to the seal member thereof can be readily adjusted in order to achieve sufficient sealing while minimizing the rate of wear of the seal member; and an end seal mechanism which permits adjustments in the positioning thereof and in the amount of force placed upon the seal member thereof during various operational stages.

SUMMARY OF THE INVENTION

The present invention provides an end seal mechanism for an air press of a papermaking machine in which the force applied upon the end seal mechanism is independent of the air pressure inside the air press, the sealing force placed thereupon and the position thereof instead being controlled by an adjustable bias mechanism.

The invention comprises, in one form thereof, an air press for pressing a fiber web, the air press including a plurality of rolls and a pair of end seal arrangements. Of the plurality of rolls, each pair of adjacent rolls forms a nip therebetween. Further, each roll has a pair of roll ends, the plurality of rolls together forming two sets of roll ends. Each end seal arrangement coacts with one set of roll ends, the plurality of rolls and the pair of end seal arrangements together defining an air press chamber having an air chamber pressure. Each end seal arrangement is composed of at least one roll seal, including a first roll seal, and an adjustable bias mechanism. Each roll seal forms a seal with at least one roll end, and one side of the first roll seal being exposed to the air chamber pressure. The adjustable bias mechanism is configured for controlling a position of each roll seal relative to a respective at least one roll end and for adjusting a seal force between the roll seal and the respective at least one roll end.

In another form, the present invention comprises a method of achieving an end seal in an air press for pressing a paper web. The method includes a series of steps, the first of which is providing a plurality of rolls, each pair of adjacent rolls forming a nip therebetween. Each roll has a pair of roll ends, the plurality of rolls together forming two sets of roll ends. An end seal arrangement is positioned adjacent a respective set of roll ends, the plurality of rolls and the respectively positioned end seal arrangements together defining an air press chamber having an air chamber pressure. Each end seal arrangement is composed of at least one roll seal, including a first roll seal, and an adjustable bias mechanism. Each roll seal forms a seal with at least one roll end, and one side of the first roll seal being exposed to the air chamber pressure. The adjustable bias mechanism is configured for controlling a position of each roll seal relative to a respective at least one roll end and for adjusting a seal force between the roll seal and the respective at least one roll end. The seal force provided by the adjustable bias mechanism is increased to seat the set of roll ends within the end seal arrangement. Then, the seal force provided by the adjustable bias mechanism is decreased upon seating of the set of roll ends within the end seal arrangement. Finally, a substantially constant low net force is maintained on each roll seal upon the seating and during operation of the air press, the substantially constant low net force being maintained using the adjustable bias mechanism.

an end seal mechanism in which the sealing force applied to the seal member thereof can be readily adjusted in order to achieve sufficient sealing while minimizing the rate of wear of the seal member; and an end seal mechanism which permits adjustments in the positioning thereof and in the amount of force placed upon the seal member thereof during various operational stages.

An advantage of the present invention is the seal force applied to the seal member of the end seal mechanism can be readily adjusted in order to achieve sufficient sealing while minimizing the rate of wear of the seal member.

Another advantage is the end seal mechanism permits adjustments in the positioning thereof and in the amount of force placed upon the seal member thereof during various operational stages, thereby facilitating the optimization of both the forces applied to the seal member during start-up to initially achieve a sufficient seal therewith and the force needed to promote a long life thereof.

Yet another advantage is that the end seal mechanism can be designed so that the total force applied on a seal member is independent of the air chamber pressure in the air press and thus not subject to potential fluctuations in the air chamber pressure.

An even further advantage is that biasing springs can be eliminated from the design of the end seal mechanism due to the presence of the adjustable bias mechanism.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
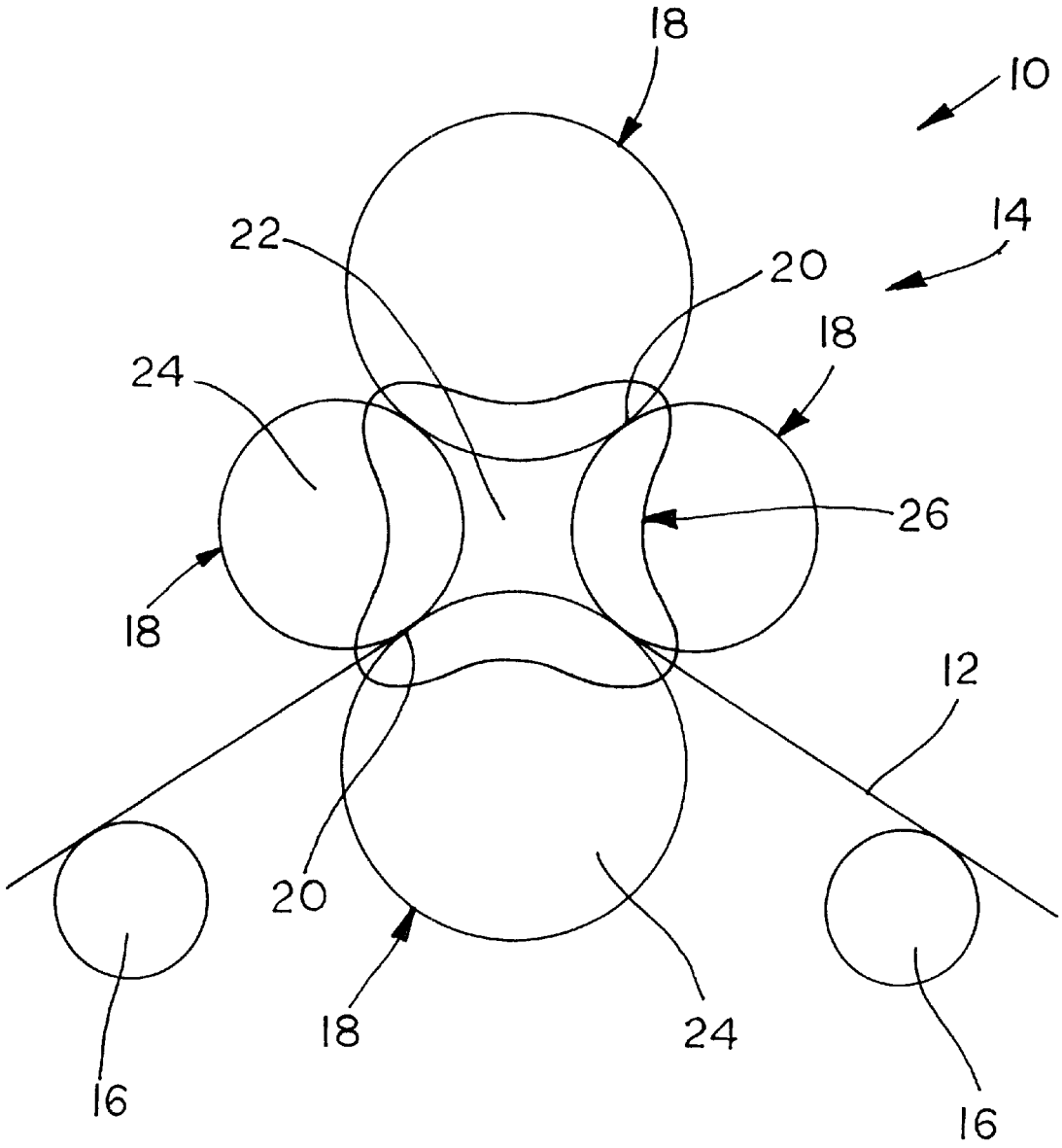
FIG. 1 is a schematic, side view of an embodiment of a papermaking machine of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a papermaking machine 10 for processing a paper web 12 which generally includes an air press assembly 14 and a plurality of conveyor rolls 16.

Air press assembly 14 is constituted of a plurality of press rolls 18 juxtaposed with one another so as to define a plurality of nips 20 therebetween and an air chamber 22 thereamongst. Contacting a set of end faces 24 of press rolls 18 is an end seal arrangement 26 for closing off what would otherwise be an open end of air chamber 22.

End seal arrangement 26 is composed of a piston holder 28 (FIG. 2), a seal piston 30, a seal holder 32, at least a first seal member 34 and an adjustable bias mechanism 36. Each end seal arrangement 26, by closing off an open end of air chamber 22, further defines air chamber 22, air chamber 22 having an air chamber pressure associated therewith. Piston holder 28, seal piston 30, seal holder 32 and first seal member 34, by each specifically helping to define the boundary of air chamber 22, are all exposed to the air chamber pressure.

Piston holder 28 acts as an outer structural member for end seal arrangement 26. Piston holder 28 has a holder side wall 38 within which seal piston 30 is movably mounted. A gasket 40 is provided in seal piston 30 adjacent holder side wall 38 to ensure sealing contact therebetween. Seal piston 30 is movably mounted within piston holder 28 so to facilitate both the positioning of and the adjustment of a biasing force B applied on at least first seal member 34.

Figure 2:
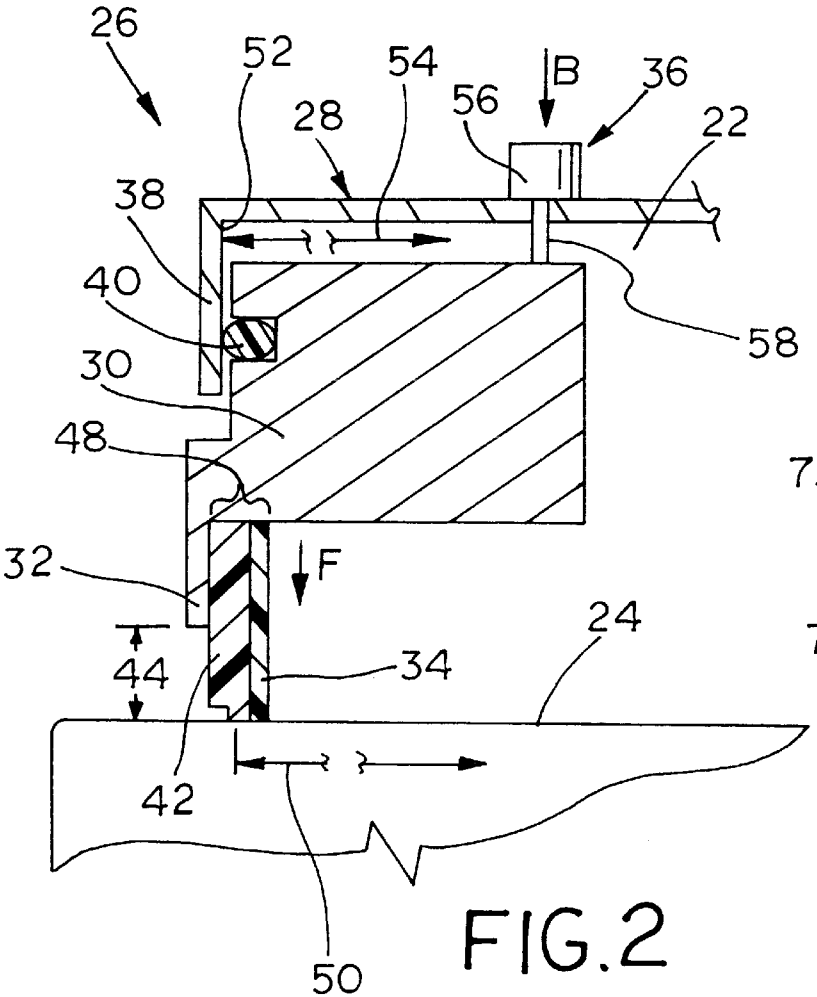
FIG. 2 is a schematic, partially-sectioned, fragmentary view of the end seal arrangement of FIG. 1.

Seal holder 32 extends from seal piston 30 opposite piston holder 28 and holds at least first seal member 34 therein. Seal holder 32 may either be integral with seal piston 30, as shown in FIG. 2, or attached thereto. First seal member 34 is configured for directly contacting and sealing with end faces 24. If only first seal member 34 is employed, first seal member 34 would advantageously made of a hard seal material and would be bonded directly to seal holder 32, in addition to being exposed to air chamber 22.

In the embodiment shown in FIG. 2, a further second seal member 42 is provided between and bonded to each of first seal member 34 and seal holder 32. First and second seal members 34, 42 can be considered roll seals as each seals with end faces 24 of press rolls 18. In this instance where two roll seals are employed, second seal member 42 is advantageously made of a hard seal material, while first seal member 34 is favorably made of a soft seal material. The soft seal material deforms to form an efficient seal interface between end seal arrangement 26 and corresponding end faces 24. Meanwhile, a hard seal material offers increased stiffness and wear resistance in comparison to a soft seal material. It is thus favorable for at least one of first and second seal members 34, 42 to be made of a hard seal material in order to ensure sufficient seal stability and to minimize the rate at which seal wear occurs, as that wear rate is set by the hardest seal material present and in contact with each end face 24. First and second seal members 34, 42 may advantageously be made of a carbon fiber (CF) composite and/or polytetrafluoroethylene (PTFE) (commonly known by its trade name "Teflon®"), respectively.

First seal member 34 and, if present, second seal member 42 are sized and configured to maintain a separation distance 44 between each end face 24 and seal holder 32 to avoid wearing of seal holder 32. As such, the time between seal member changes is dictated by the wear time needed to cause separation distance 44 to reach zero.

In the embodiment of FIG. 2, first seal member 34 and second seal member 42 together define a seal boundary 48, seal boundary 48 encompassing a pressurized seal area 50 (schematically shown) therewithin. Similarly, inner holder face 52 of holder side wall 38 bounds and thereby defines a pressurized piston area 54 (schematically shown). Since, in the embodiment shown in FIG. 2, pressurized seal area 50 is approximately equal to pressurized piston area 54, the pressures are balanced throughout seal boundary 48, advantageously resulting in essentially no net chamber seal force F being applied upon first seal member 34 and/or second seal member 42, regardless of the air chamber pressure. Under balanced pressure conditions, chamber seal force F is independent of the air chamber pressure.

In the embodiment of FIG. 2, both seal boundary 48 and holder side wall 38 define a similar dog-bone shape (FIG. 1). It is contemplated that those shapes could differ (e.g., seal boundary 48 could define a dog-bone shape and holder side wall 38, a circle) as long as the areas encompassed thereby were essentially the same.

By achieving no net chamber seal force F regardless of air chamber pressure, the risk is avoided of underloading first seal member 34 and/or second seal member 42 in the case of a drop in air chamber pressure and of thus inviting possible leakage and/or slow seal breakage. Likewise, the risk of overloading first seal member 34 and/or second seal member 42 in the case of a rise in air chamber pressure and thus wearing out first seal member 34 and/or second seal member 42 at an even greater rate is also avoided when pressures are balanced. If, for example, pressurized piston area 54 were instead greater than pressurized seal area 50, chamber seal force F would exist on first seal member 34 and/or second seal member 42 due to the air chamber pressure, chamber seal force F increasing with increasing air chamber pressure. In certain instances, it may prove desirable to have pressurized piston area 54 be slightly greater than pressurized seal area 50 so that a small chamber seal force F and, thus, a sealing function would exist in all operational situations.

Adjustable bias mechanism 36 is configured for controlling a position of first seal member 34 and, if present, second seal member 42 relative to a respective set of end faces 24 and for providing a biasing force B between each of first seal member 34 and second seal member 42, if present, and respective end faces 24. Adjustable bias mechanism 36 is capable of generating the smallest possible biasing force B needed to create a suitable seal between each of first seal member 34 and second seal member 42, if present, and respective end faces 24. It is advantageous to apply the smallest possible biasing force B needed to create a suitable seal as seal wear can be minimized thereby.

Adjustable bias mechanism 36 is advantageously capable of ensuring that first seal member 34 and second seal member 42, if present, are engaged when air chamber 22 is pressurized; retracting end seal arrangement 26 for startup and maintenance; and regulating biasing force B such that biasing force B is increased during seal break in and decreased once seated to maximize seal life. The ability to retract end seal arrangement 26 when nips 20 are being closed avoids the possibility of first seal member 34 and/or second seal member 42 being broken by end faces 24 catching thereon. Further, since biasing force B is independent of chamber seal force F, even if chamber seal force F is not zero, end seal arrangement 26 can be closed and loaded independently of air chamber pressure. As a result of such independence, such a design can advantageously eliminate the need for springs in the end seal arrangement.

In the embodiment shown in FIG. 2, adjustable bias mechanism 36 includes an air cylinder 56 and an air cylinder shaft 58. Air cylinder 56 may either be mounted outside of piston holder 28 (as shown in FIG. 2) or inside thereof (not shown). Air cylinder shaft 58 is selectively driven by air cylinder 56 and operably connects air cylinder 56 with seal piston 30. If air cylinder 56 is mounted outside of piston holder 28 with air cylinder shaft 58 accordingly extending therethrough, appropriate seals (not shown) are advantageously provided between air cylinder shaft 58 and piston holder 28 to minimize leakage therebetween.

Figure 3:
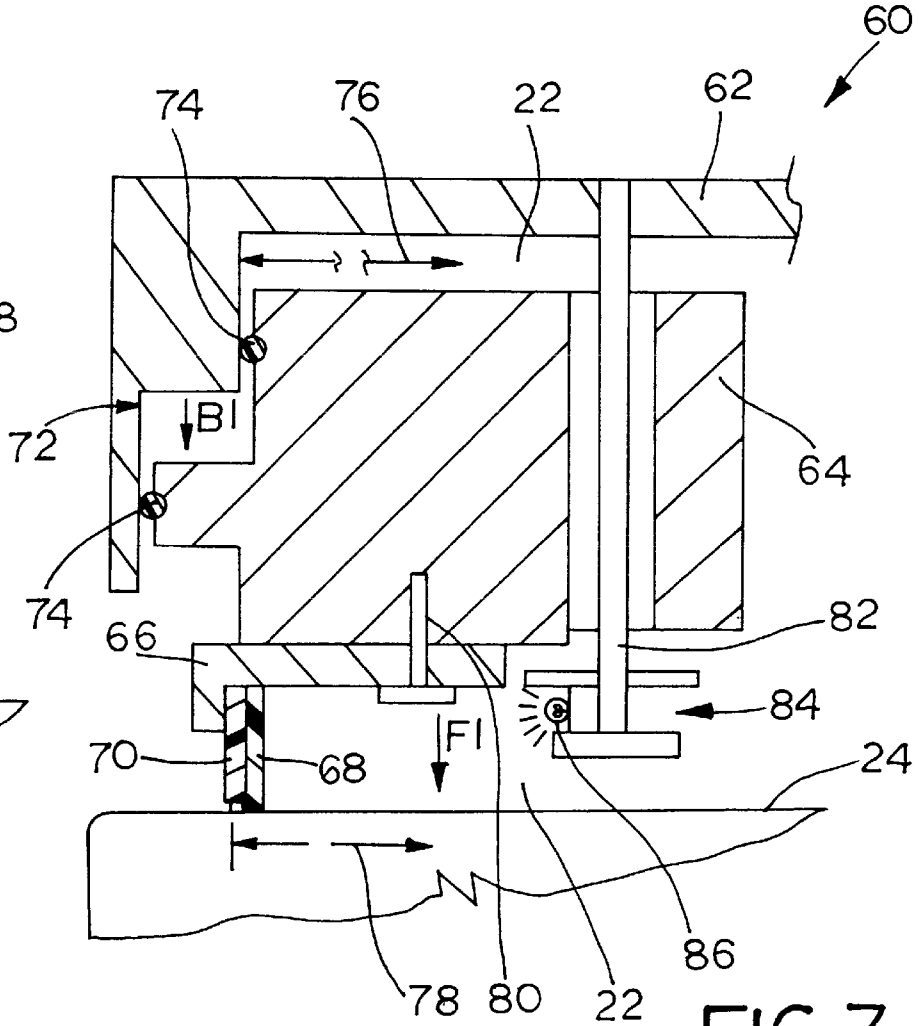
FIG. 3 is a schematic, partially-sectioned, fragmentary view of another embodiment of an end seal arrangement which can be employed in the papermaking machine shown in FIG. 1.

In operation, end seal arrangement 26 is positioned adjacent a set of end faces 24 of press rolls 18. Air cylinder 56 of adjustable biasing mechanism 36 is first used to apply an increased biasing force B during break in of first and second seal members 34, 42. Biasing force B is then decreased once seated to a minimum force needed to maintain a sufficient seal between end faces 24 and first and second seal members 34, 42 to maximize seal life thereof End seal arrangement 60, shown in FIG. 3, is a second embodiment of the end seal arrangement of the present invention. End seal arrangement 60 is composed of a piston holder 62, a seal piston 64, a seal holder 66, a first seal member 68, a second seal member 70 (optional in the same manner as the first embodiment, requiring first seal member 68 to be bonded directly to seal holder 66 if not used) and an adjustable bias mechanism 72. Each end seal arrangement 60, by closing off an open end of air chamber 22, further defines air chamber 22, air chamber 22 having an air chamber pressure associated therewith. Piston holder 62, seal piston 64, seal holder 66 and first seal member 68, by each specifically helping to define the boundary of air chamber 22, are all exposed to the air chamber pressure.

Only those features which differ from those of the first embodiment will be discussed in detail with respect to this second embodiment.

Piston holder 62, seal piston 64 and o-rings 74 together define adjustable bias mechanism 72. Adjustable bias mechanism 72 has an adjustable biasing pressure therein, a net biasing force B1 produced thereby being a function of the difference between the biasing pressure therein and the atmospheric pressure outside of end seal arrangement 60. In a manner similar to that for the first embodiment, piston holder 62 encompasses a pressurized piston area 76, and the combination of first and second seal members 68, 70 bounds and thereby defines pressurized seal area 78, and pressurized piston area 76 is essentially equal to pressurized seal area 78, thereby producing no net chamber seal force F1.

As such, the only net force placed on first and second seal members 68, 70 is one generated by adjustable bias mechanism 72, i.e., biasing force F1. Thus, if the biasing pressure is equal to atmospheric pressure, biasing force B1 is equal to zero, resulting in no downward force on first and second seal members 68, 70. However, a biasing pressure in excess of atmospheric produces a positive biasing force B1, resulting in a downward force on first and second seal members 68, 70. Conversely, first and second seal members 68, 70 can be retracted from end faces 24 by applying a less than atmospheric pressure (e.g., a vacuum) within adjustable bias mechanism 72.

Other features of the second embodiment which differ from the first are apparent in FIG. 3. Seal holder 66 is separate from seal piston 64 and is attached thereto via a holder attachment mechanism 80 (e.g., a bolt or screw). Using a separate seal holder 66 eases seal member replacement but introduces the requirement of attaining a sufficient seal between seal holder 66 and seal piston 64.

Both lateral and vertical movement of seal piston 64 relative to piston holder 62 is limited by piston attachment mechanism 82 (e.g., a bolt or other attachment pin). Piston attachment mechanism 82 extends through seal piston 64 and is mounted in piston holder 62. Piston attachment mechanism 82 is supplied with a head 84, head 84 acting as a vertical movement stop for seal piston 64.

Additionally, an indicator light 86 (e.g. an LED) is provided on head 84 to act as a visual indicator of a gap and thus a potential leak site between end faces 24 and end seal arrangement 60. Such an indicator light 86 could also be advantageously employed within the first embodiment.

Operation of end seal arrangement 60 is similar to that of end seal arrangement 26 with the exception of using a variable biasing pressure within adjustable bias mechanism 72 to produce the desired biasing force B1.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air press for pressing a fiber web, said air press comprising:

a plurality of rolls, each pair of adjacent rolls forming a nip therebetween, each said roll having a pair of roll ends, said plurality of rolls together forming two sets of roll ends;

a pair of end seal arrangements, each said end seal arrangement coacting with one set of roll ends, said plurality of rolls and said pair of end seal arrangements together defining an air press chamber having an air chamber pressure, each said end seal arrangement comprising:

at least one roll seal including a first roll seal, each said roll seal forming a seal with at least one roll end, one side of said first roll seal being exposed to said air chamber pressure; and an adjustable bias mechanism configured for controlling a position of each said roll seal relative to a respective at least one said roll end and for adjusting a seal force between said roll seal and said respective at least one said roll end.

2. The air press of claim 1, wherein each said end seal arrangement further comprises a piston holder, a seal piston mounted within said piston holder and a seal holder extending from said seal piston opposite said piston holder, said at least one said roll seal being held by said seal holder.

3. The air press of claim 2, wherein said piston holder has a pressurized piston area therewithin, said at least one said roll seal bounding and thereby defining a pressurized seal area, said pressurized piston area being equal to said pressurized seal area.

4. The air press of claim 3, wherein the seal force required to produce a seal between said at least one said roll seal and a corresponding said set of roll ends is independent of the air chamber pressure.

5. An end seal arrangement for an air press for pressing a material web, the air press defining an air chamber having an air chamber pressure therein, the air press including a plurality of rolls, each said roll having a pair of roll ends, said end seal arrangement comprising:

at least one roll seal, each said roll seal configured for forming a seal with at least one said roll end, said at least one roll seal including a first roll seal, said first roll seal having one side thereof exposed to said air chamber pressure; and an adjustable bias mechanism configured for controlling a position of each roll seal relative to a respective at least one roll end and for adjusting a seal force between said roll seal and the respective at least one roll end.

6. The end seal arrangement of claim 5, wherein each end seal arrangement further comprises a piston holder, a seal piston mounted within said piston holder and a seal holder extending from said seal piston opposite said piston holder, said at least one roll seal being held by said seal holder.

7. The end seal arrangement of claim 6, wherein said piston holder has a pressurized piston area therewithin, said at least one said roll seal bounding and thereby defining a pressurized seal area, said pressurized piston area being equal to said pressurized seal area.

8. The end seal arrangement of claim 6, wherein said seal holder is one of integrally formed with and releasably attached to said seal piston.

9. The end seal arrangement of claim 8, wherein said seal holder is releasably attached to said seal piston.

10. The end seal arrangement of claim 5, wherein said adjustable bias mechanism is configured to operate independent of the air chamber pressure.

11. The end seal arrangement of claim 6, wherein said adjustable bias mechanism is an air cylinder mounted against said piston holder, said air cylinder having a cylinder shaft extending therefrom and connected to said seal piston.

12. The end seal arrangement of claim 11, wherein said air cylinder and said cylinder shaft conjunctively are configured for positioning said seal piston and thereby controlling said seal force between said roll seal and said respective at least one said roll end.

13. The end seal arrangement of claim 6, wherein said piston holder, said seal piston and a pair of perimeter seal members positioned therebetween define a second chamber, said second chamber being independent of said air chamber, said second chamber having a second chamber pressure associated therewith, the second chamber pressure being adjustable, said second chamber thereby defining said adjustable bias mechanism.

14. The end seal arrangement of claim 13, wherein said second chamber is configured such that the second chamber pressure therein can be varied so as to selectively retract and extend said at least one roll seal.

15. The end seal arrangement of claim 6, wherein said first roll seal has a first hardness, said at least one said roll seal further including a second roll seal, said second roll seal having a second hardness greater than said first hardness, said second roll seal being positioned between and bonded to said seal holder and said first roll seal.

16. A method of achieving an end seal in an air press for pressing a paper web, said method comprising the steps of:

providing a plurality of rolls, each pair of adjacent rolls forming a nip therebetween, each said roll having a pair of roll ends, said plurality of rolls together forming two sets of roll ends;

positioning an end seal arrangement adjacent a respective set of roll ends, said plurality of rolls and said respectively positioned end seal arrangements together defining an air press chamber having an air chamber pressure, each end seal arrangement comprising:

at least one roll seal, each roll seal forming a seal with at least one roll end, one side of each roll seal being exposed to said air chamber pressure; and an adjustable bias mechanism configured for controlling a position of each roll seal relative to a respective at least one roll end and for adjusting a seal force between said roll seal and said respective at least one said roll end;

increasing the seal force provided by said adjustable bias mechanism to seat said set of roll ends within said end seal arrangement;

decreasing the seal force provided by said adjustable bias mechanism upon seating of said set of roll ends within said end seal arrangement; and maintaining a substantially constant low net force on each said roll seal upon said seating and during operation of said air press, the substantially constant low net force being sufficient for creating a seal between each said roll seal and said respective roll end while minimizing seal wear, and being maintained using said adjustable bias mechanism.

17. The method of claim 16, further comprising the step of, prior to said positioning step, retracting said end seal arrangement from said set of roll ends by using said adjustable bias mechanism.

18. The method of claim 17, wherein said retracting step permits at least one of startup and maintenance to occur.

19. A papermaking machine for processing a fiber web, the papermaking machine comprising:

a plurality of conveyor members for carrying the fiber web; and an air press for pressing the fiber web, said air press receiving the fiber web from at least one said conveyor member, said air press comprising:

a plurality of rolls, each pair of adjacent rolls forming a nip therebetween, each said roll having a pair of roll ends, said plurality of rolls together forming two sets of roll ends;

a pair of end seal arrangements, each said end seal arrangement coacting with one set of roll ends, said plurality of rolls and said pair of end seal arrangements together defining an air press chamber having an air chamber pressure, each said end seal arrangement comprising:

at least one roll seal including a first roll seal, each said roll seal forming a seal with at least one roll end, one side of said first roll seal being exposed to said air chamber pressure; and an adjustable bias mechanism configured for controlling a position of each said roll seal relative to a respective at least one said roll end and for adjusting a seal force between said roll seal and said respective at least one said roll end.

* * * * *